US006840833B1

(12) United States Patent
Motowaki et al.

(10) Patent No.: US 6,840,833 B1
(45) Date of Patent: Jan. 11, 2005

(54) GAS DISCHARGE TYPE DISPLAY PANEL AND PRODUCTION METHOD THEREFOR

(75) Inventors: Shigehisa Motowaki, Hitachi (JP); Tomohiko Murase, Miyazaki (JP); Michifumi Kawai, Tokyo (JP); Ryohei Sato, Yokohama (JP); Yasuhiro Matsuoka, Miyazaki (JP); Yoshihiro Kato, Yokohama (JP); Takashi Naito, Mito (JP); Yasutaka Suzuki, Juo-machi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/890,302

(22) PCT Filed: Jan. 28, 2000

(86) PCT No.: PCT/JP00/00476

§ 371 (c)(1),
(2), (4) Date: Jul. 27, 2001

(87) PCT Pub. No.: WO00/45411

PCT Pub. Date: Aug. 3, 2000

(30) Foreign Application Priority Data

Jan. 29, 1999 (JP) ..... 11-021221

(51) Int. Cl.[7] ..... H01J 9/26
(52) U.S. Cl. ..... 445/25; 445/24
(58) Field of Search ..... 445/24, 25; 313/495–497, 313/582

(56) References Cited

U.S. PATENT DOCUMENTS 3,701,368 A * 10/1972 Stern ..... 141/1
3,837,724 A * 9/1974 Haberland et al. ..... 445/25
3,849,190 A * 11/1974 Foster et al. ..... 313/587
3,858,284 A * 1/1975 Costa et al. ..... 445/25
4,071,287 A * 1/1978 Sherk ..... 445/25
4,475,060 A * 10/1984 Aboelfotoh ..... 313/587
5,007,872 A * 4/1991 Tang ..... 445/25
5,207,607 A * 5/1993 Nagano et al. ..... 445/25
5,797,780 A * 8/1998 Peng ..... 445/25
5,807,154 A * 9/1998 Watkins ..... 445/25
6,006,003 A * 12/1999 Kim ..... 385/147
6,109,994 A * 8/2000 Cho et al. ..... 445/25
6,287,995 B1 * 9/2001 Lee ..... 501/15
6,537,121 B1 * 3/2003 Baret ..... 445/25
6,538,380 B1 * 3/2003 Kanagu et al. ..... 313/582
6,603,260 B1 * 8/2003 Kim et al. ..... 313/562

FOREIGN PATENT DOCUMENTS

JP 53141572 A * 12/1978 ..... H01J/9/24
JP 56038734 A * 4/1981 ..... H01J/9/395

* cited by examiner

*Primary Examiner*—Dean A. Reichard
*Assistant Examiner*—Adolfo Nino
(74) *Attorney, Agent, or Firm*—Antonelli, Terry, Stout & Kraus, LLP

(57) ABSTRACT

In the manufacture of a gas discharge type display panel, by applying a sealing operation along with an exhausting operation, the sealing glass 14 is broken down by a pressure difference between the inside and outside of the panel, and thus, the clearance gap between the substrates can be controlled as desired. In addition, the gaseous component that is unnecessary for the discharge operation is exhausted by setting the temperature of the amorphous sealing glass to exceed its softening-point and be no more than its working point. In the structure of the gas discharge type display panel, a protruding portion having a radius of curvature between 0.1 mm and 1 mm is formed on the sealing glass to reduce the dispersion in the thickness direction of the sealing glass, or the cross-sectional shape of the sealing glass is made convex both at its inside end part and its outside end part.

14 Claims, 14 Drawing Sheets

1

GAS DISCHARGE TYPE DISPLAY PANEL AND PRODUCTION METHOD THEREFOR

BACKGROUND OF THE INVENTION

This invention relates to a gas discharge type display panel, such as a plasma display panel, and a method of manufacture thereof.

The production of a gas discharge type display device, especially production processes from seal frit formation to sealing and exhausting, is described in "FPD Intelligence" magazine (June, 1998), pages 84 through 88, for example. The description at page 86 indicates the necessity of selecting an exhaust temperature not exceeding the softening point of the sealing glass.

Also, in a method of manufacture of a gas discharge type display panel, such as a plasma display panel, it is necessary to exhaust the inside of the panel in advance of the inclusion of a discharge gas. To do this, in addition to the above-mentioned method of exhausting only the inside of the panel after the sealing, a method of exhausting the whole of a furnace during the sealing so as to exhaust both the inside and outside of the panel at one time is also known. One example of such a method is disclosed in Japanese Patent Prepublication No. 326572/1998.

SUMMARY OF THE INVENTION

In a gas discharge type display panel, such as a plasma display panel, as a sealing glass, a material in paste form including an organic substance (binder) as an additive, which facilitates the application of glass frit, is often used. This organic substance is burned during calcination, sealing and exhausting processes and is emitted to the outside of the panel as a gas. However, a small quantity of the gas unusually remaining within the sealing glass after tip off may appear inside of the panel when the panel is discharged. From the sealing glass, the gas involved at the time of sealing, in addition to the gas associated with the binder, leaks into the inside of the panel while discharging, which may contribute to the lowering of brightness when lighting the panel over an extended time period. The first object of the present invention is to provide a gas discharge type display panel which produces a lower amount of discharged gas from the sealing glass when discharging over an extended time period and less lowering of brightness when lighting the panel over an extended time period.

There are cases in which the cross-sectional shape of the sealing glass disposed between substrates at both the end face thereof on the internal space side and the end face on the external side is convex in shape, as shown in FIG. 4(*b*), and, in contrast, in which the cross-sectional shape at both end faces is concave, as shown in FIG. 4(*c*), in which the size of the cross-sectional area parallel to the substrates varies widely. The exterior stress and the internal stress due to the difference in thermal expansion between the sealing glass and the distortion of the substrates are applied uniformly inside of the sealing glass. Owing to this, there is a problem in the conventional gas charge type display panels in that the portion having a small cross-sectional area, especially for the cross-sectional area of the sealing glass parallel to the substrates, has a lower strength. The second object of the present invention is to provide a gas discharge type display panel having a high reliability in mechanical strength.

In the conventional method of manufacture of gas discharge type display panels, such as plasma display panels, though an amorphous glass frit, rather than a crystalline glass frit, is typically used in consideration of the advantages in process temperature margin, the amorphous glass has such a characteristic that it is fused when reheated after sealing. In the process of manufacturing a gas discharge type display panel, a case may accidentally occur in which the gas that is unnecessary for effective discharge remains inside the panel, for example, due to an absorption of moisture content or carbon dioxide gas on the MgO film of the protection layer of the plasma display panel. Though the manufacturing method certainly employs a process for removing those gaseous impurities by exhausting the inside of the panel at a high temperature, if the seal frit gets soft at too high a temperature due to inadequate temperature control and leaks accidentally, the display operation is disabled. Thus, in case of applying an amorphous glass frit to the seal frit of the gas discharge type display panel, the gas temperature for exhausting in high temperature conditions has been selected to be no more than the temperature at the softening point of the seal frit. On the other hand, in terms of removing the gaseous impurities efficiently, it is preferable to use as high a temperature as possible for high-temperature exhaust operations.

As for another exhaust method, there is a method in which, after sealing the front substrate and the back substrate by fusing and fixing the conventional sealing glass, only the inside of the panel is exhausted in a vacuum along with baking the inside of the panel. In this method, in case the distance between the front substrate and the back substrate is as small as several hundred mm, it could takes several hours to exhaust the internal gas completely due to high exhaust conductance; and, especially, in case the discharge areas are formed by closed cells separated by separation walls, the complete exhausted state can not be established.

On the other hand, in a method in which the whole of the furnace is exhausted in a vacuum when sealing, and the inside and outside of the panel are exhausted simultaneously, it is required to use procedures including steps for exhausting the whole of the furnace itself or to use a vacuum chamber formed to be large enough to enclose the panel at first, and then to fill the chamber with a larger quantity of discharge gas than the volume of the inside of the panel, which requires an upsizing of the manufacturing apparatus and reduces its productivity. The third object of the present invention is to provide a gas display type display panel and its manufacturing method which makes it possible to establish a high efficiency in exhaust operations and reduce the gaseous impurities which remain in the final product.

Since the aforementioned methods use a pressurizing clip in high temperature conditions, such clips should have heat resisting properties; however, such a clip may be high-priced and may be damaged by repetitive use in the manufacturing process, or degraded for a designated clip pressure. In addition, for gas discharge type display panels, such as plasma display panels, though plural substrates can be manufactured from a single glass plate, as in the manufacture of liquid crystal panels, even in trying to form a single plate by sealing them together at first and then separate them into plural panels later, since it is difficult to apply a uniform load onto the connecting parts between the panels in the sealing process, there has been a problem in that special tools for pressurizing operations are required, leading to a further increase in cost. The fourth object of the present invention is to provide a manufacturing method which only uses clips for temporary fixing and protecting against displacement in order to apply pressure in sealing the front substrate and the back substrate and which makes it possible to seal plural panels simultaneously with a high yield rate.

The sealing operations are performed typically in a temperature range corresponding to the viscosity between 104 (working point) and 107.65 (softening point). The present invention uses a seal frit formed by adding fillers to PbO—$B_2O_3$ system glasses, and with this seal frit there was not found any leakage or large scale displacement of the sealing glass toward the inside of the panel, and the sealing glass could be broken down to a thickness equivalent to the height of the separation wall merely in response to the difference in the pressure between the inside and outside of the panel, without using any special pressurizing clip, even if the inside of the panel is exhausted at a temperature exceeding the temperature corresponding to the softening point and less than the temperature corresponding to the working point. In addition, it has been found that there are protruding portions having a radius of curvature between 0.1 mm and 1 mm, measured from the display surface, on the sealing glass over its internal space as a whole. The aforementioned first embodiment can be attained by allowing the surface glass to have protruding portions having a radius of curvature between 0.1 mm and 1 mm, measured from the display surface, on the sealing glass over its internal space as a whole.

The aforementioned second embodiment of the present invention can be attained by causing the shape of the cross-sectional area of the sealing glass and at both the end face of the internal space side and the end face of the external side to be convex at least at one part of the periphery of the substrate.

Furthermore, as the exhaust operations are applied to the sealing glass having a clearance gap between the separation wall and the front substrate before the sealing glass is broken down, when exhaust operations are performed in the sealing process, exhaust operations with high efficiency can be performed and the resultant concentration of gaseous impurities can be reduced. With this method, the exhaust operations can be carried out smoothly for a gas discharge type display panel, in which the discharge space formed as cells separated by separation walls is typically exhausted with more difficulty during exhausting operations than a gas discharge type display panel having a straight separation wall structure. By using two different kinds of sealing glasses having different softening points, one sealing glass is sealed at a lower temperature at first, which is designed to make the sealing glass having a higher softening point operate as a spacer and to exhaust the existing clearance gap between the separation wall and the front substrate, and then, heating it to a higher temperature in order to seal with the sealing glass having a higher softening point, the temperature profile for sealing and exhausting operations may have higher freedom with respect to time and temperature, and, consequently, exhausting operations with higher efficiency can be performed easily during the temperature rise phase. In addition, even in a case in which the exhaust operations are performed after sealing, exhausting operations with higher efficiency can be performed by selecting the operation condition having a temperature range exceeding the softening point and no more than the working point, and, consequently, the resultant concentration of the remaining gaseous impurities can be reduced. The aforementioned third object of the present invention can be attained by exhausting the inside of the panel during the sealing process and by applying the exhausting operations in a temperature range exceeding the softening point and no more than the working point.

In case of using a sealing glass containing a filler, when the inside of the panel is exhausted in the sealing process, the filler is drawn firmly toward the inside space and the average filler concentration from the end face of the internal space side to the range of 100 mm may be 10% or more higher than the average filler concentration in the other part. In such a case, since the liquidity in the inside space can be reduced by collecting the filler in the inside space when sealing, the sealing glass does not move largely to the inside space even if the exhausting operations at a higher temperature are applied later, and the volume for the exhaust route can be effectively reserved. In this case, though a problem may unexpectedly arise in that only the thermal expansion at the inside space becomes lower, since there are many concave and convex parts in the inside space in a practical sense, and thus, the distortion due to the difference in the thermal expansion between the substrate and the inside space may be relaxed, this does not lead to such a severe problem as cracks and large-scale distortion for the whole panel.

In case of using $V_2O_5$—$P_2O_5$ system glasses having a lower thermal expansion coefficient without a filler to be added, instead of using PbO—$B_2O_3$ system glasses with a filler added as a seal frit, as the liquidity at the high temperature becomes higher, the sealing glass will move largely to the inside space and may leak accidentally. In order to prevent this problem, a glass layer having a higher heat resistance than the sealing glass is formed so as to be adjacent to the end face of the inside space or located within 2 mm from the end face in order to block the flow of the sealing glass. This glass layer may be formed by a material identical to the material used for the separation wall at the same time when the separation wall is formed, or it may be formed by adding another seal frit around the inside space.

By exhausting when sealing, due to the pressure difference between the inside and outside of the panel, as described above, the sealing glass can be broken down to a thickness equivalent to the height of the separation walls without using pressurizing clips. Also, in a case in which two or more gas discharge type display panels are manufactured from a couple of substrates, the parts which can not be sufficiently pressurized by the conventional pressurizing clips may be pressurized by exhausting at the same time as sealing, and thus, since the sealing can be established with a higher yield rate independently using the layout method of two or more gas discharge type display panels, it is possible attain the fourth object of the present invention.

In a case in which the seal frit is used for sealing the substrates, due to a pressure difference between the inside and outside of the panel, the seal frit made of crystalline glass frit (also including filler materials conditionally) may not be broken down completely if the exhaust operations are performed before the viscosity of the material increases due to crystallization. Thus, since there is such a severe time condition for pressure reduction, it is preferable to use an amorphous glass frit (also including filler materials conditionally) as the seal frit used for sealing the substrates.

As for the seal frit used for bonding the exhaust tube, by making the shape of the exhaust tube so as to allow the area of the bonding surface between the exhaust tube and the substrate to be large enough, there will be no leakage problem in the exhaust operations performed at high temperature even that is using an amorphous glass frit (also including filler materials conditionally) identical to the material used for sealing the substrate. However, when "an amorphous glass frit (also including filler materials conditionally) having higher softening point is used for bonding the exhaust pipe, and an amorphous glass frit (also including filler materials) having lower softening point is used for sealing the substrate", or "a crystalline glass frit (also including filler materials conditionally) having higher softening point is used for bonding the exhaust pipe, a crystalline glass frit (also including filler materials conditionally) having lower softening point is used for sealing the substrate, and then the exhaust operations are applied after completing the crystallization of the crystalline glass and fixing the exhaust tube", by making the materials used for seal frits for bonding the exhaust tube have higher heat resistance than the materials for sealing the substrate, there will be no problem of leakage from the bonding part of the exhaust tube independently of the shape of the exhaust tube.

The exhaust tube is typically designed and manufactured so that the exhaust port may be connected to the end side of the bonding part to the substrate, and after the exhaust operations have been completed and the internal gas is completely exchanged, the exhaust pipe near the bonding part to the substrate may be burned off for sealing. Alternatively, a glass component shaped in the form of a short exhaust pipe is connected to the substrate, and, without connecting an exhaust port to the glass component individually, a larger exhaust port is connected to the substrate and the exhaust operations are applied to the enclosure of the glass component, and then the glass component is heated for burning off. However, in case of using the glass component exclusively for this way of sealing, the present invention can give an identical effect brought about by the same method as described above.

PREFERRED EMBODIMENT OF THE INVENTION (Embodiment 1)

A method of manufacture of plasma display panels representing a first embodiment of the present invention will be described. In this embodiment, a sealing method is used in which the panel is sealed while being subjected to an exhaust operation, and the sealing glass is broken down by using the pressure difference between the inside and outside of the panel. For comparison, a panel manufactured by the conventional sealing method in which the panel is pressurized by clips will be studied as well.

In this embodiment, the pattern for the sealing glass 14 is formed by a dispensing method applied to the back substrate 2, and then, the seal frit is formed by drying and removing the binders. An amorphous glass type seal frit (390° for softening point, 450° for working point and also including the filler materials) is used for the sealing glass 14.

Figure 2:
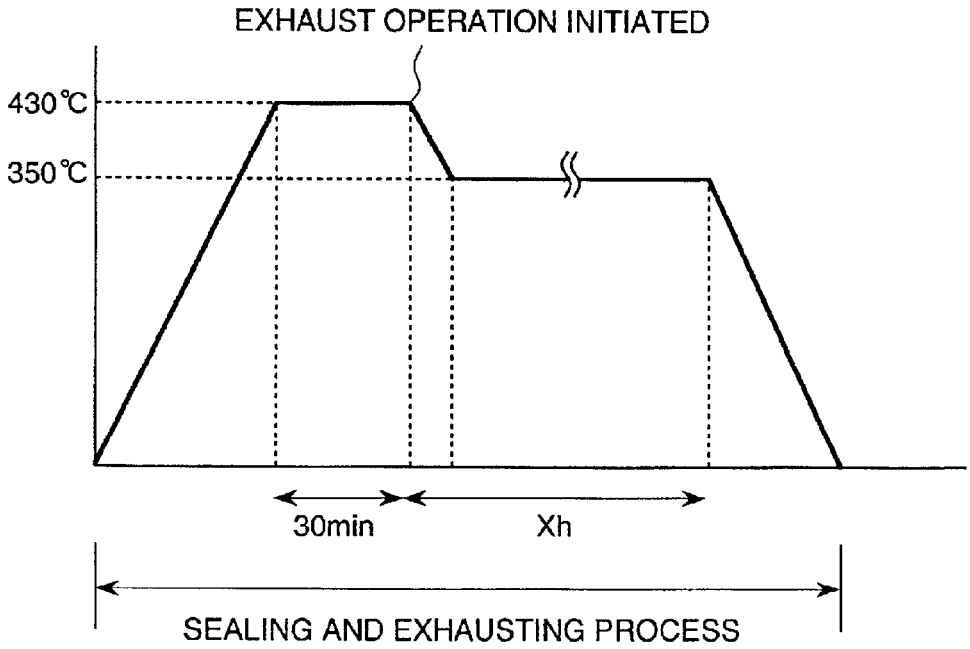
FIG. 2 is a diagram which shows temperature profiles at the sealing and exhausting operations in the first embodiment.

Next, the processes performed after the sealing and exhaust operations will be described. In FIG. 2, a temperature profile for the sealing and exhaust operations is shown. FIG. 2 illustrates the temperature profiles of panels being exhausted during the sealing operation. The sealing and exhaust processes in accordance with the present invention include a heating-up process for increasing the temperature up to the sealing temperature (450° C.), followed by a first heat insulation process for maintaining the sealing temperature, a cool-down process for initiating the exhaust operation after the completion of the first heat insulation process and for reducing the temperature down to the degasification temperature (430° C.), followed by a second heat insulation process for maintaining the degasification temperature, and finally a cool-down process for reducing the temperature down to room temperature. In the conventional method, the sealing is completed from the cool-up process to the heating-down process along with pressurization of the face substrate 1 and the back substrate 2, and then, the exhaust operation is initiated and this is followed by the heat insulation process and the cool-down process.

Figure 3A:
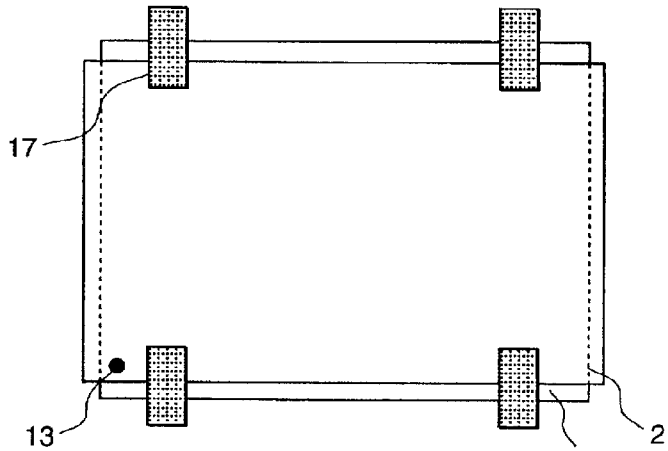
FIGS. 3(*a*) to 3(*c*) are diagrams which illustrate stepwise changes in the panel formation after the sealing process in the first embodiment.
Figure 3B:
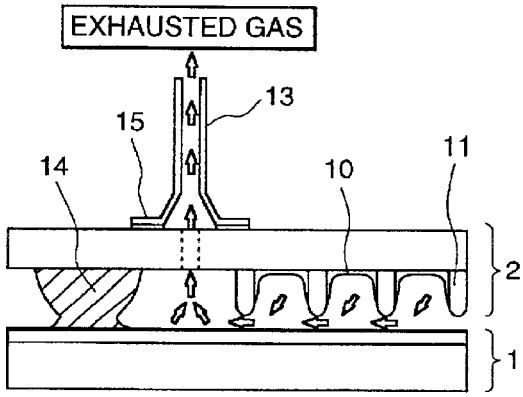
Figure 3C:
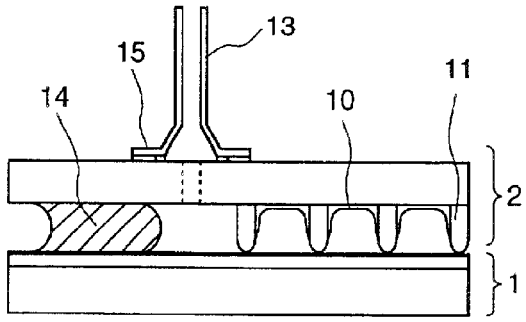

FIGS. 3(*a*) to 3(*c*) show a stepwise change in the panel states in the exhausting operation performed during the sealing operation.

(1) At first, the locations of the front substrate 1 and the back substrate 2 prepared by the above-described processes are adjusted so that the display electrode and bus electrode, both formed at the front substrate 1, and the address electrode 10 formed at the back substrate 2 are orthogonal to each other. The clip 17 is provided with a weak clip force because its purpose is not to break down the sealing glass 14. Any component other than clips may be employed so long as the component provides no displacement of the sealing glass. Placing the back substrate 2 at the upper side, the exhaust pipe 13, which is coated and burned with amorphous glass type seal frit 15 (including filler materials), is fixed above the exhaust hole by an anchor. The composite substrates are placed inside a furnace and an exhaust head is coupled to the exhaust pipe 13.

FIG. 3(*a*) illustrates a panel configuration in which the panel to be exhausted when sealing is installed in the sealing furnace. For simple explanation, only the outline of the front substrate 1 and the back substrate 2 is shown, and the illustration of the clips 17 used for temporarily fixing the panel is also simplified. In addition, the anchor for fixing the exhaust pipe 13 is not shown.

The temperature is raised up to the sealing temperature of 430° C. FIG. 3(*b*) shows the state of the sealing glass 14 immediately after the temperature reaches 430° C., as well as the action which occurs in the clearance gap between the front substrate 1 and the back substrate 2. The sealing glass 14 gets soft and contacts the front substrate 1, so that the air tightness of the periphery of the substrates can be maintained, but the clearance gap between the substrates does not reach the height of the separation wall 11 because a pressurizing clip is not being used. The seal frit 15 used for bonding the exhaust pipe 13 and the back substrate 2 is not fully crystallized and stays in a state in which its viscosity is low.

(2) After the temperature reaches the sealing temperature of 430° C., the temperature is kept constant for 30 minutes. During this process, the seal frit 15 completes its crystallization, and the exhaust pipe 13 firmly contacts the back substrate 2. In this state, the exhaust operation is initiated.

(3) The temperature is reduced in parallel with the initiation of the exhaust operation. The pressure inside the panel reaches $10^{-2}$ to $10^{-4}$ Torr in one or two minutes after starting the exhaust operation, and the sealing glass 14 is broken down by the pressure difference between the inside and outside of the panel. FIG. 3(*c*) shows the state of the sealing glass 14 after the break-down thereof is completed and shows the clearance gap between the front substrate 1 and the back substrate 2.

(4) The temperature is kept constant at 350° C. in the process of reducing the temperature while the exhaust operation continues, and the gas that is unnecessary for discharge operations is extracted. After cooling the panel down to room temperature, the discharge gas is led through the exhaust pipe 13 to the discharge space so as to make the pressure reach 300 Torr, and then the exhaust pipe 13 is burned off by localized heating, after which the formation of the gas discharge type display apparatus is finished.

Figure 1A:
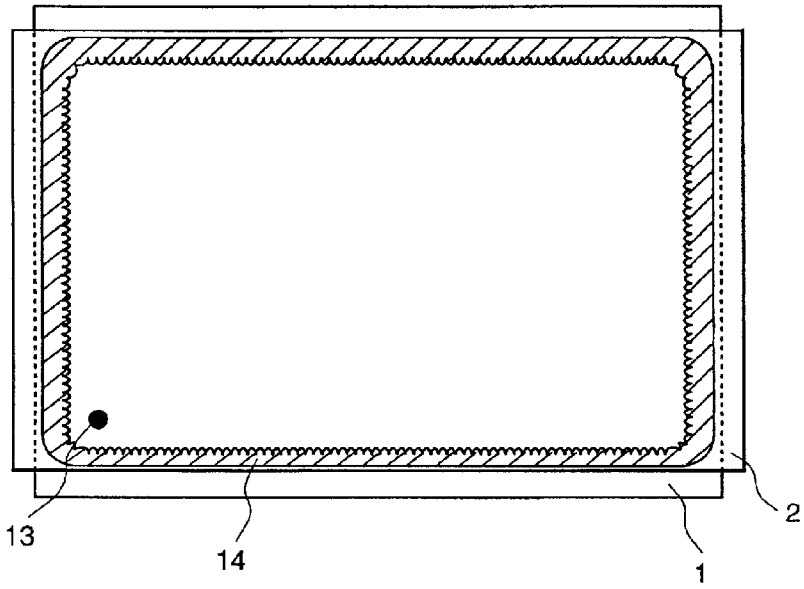
FIG. 1(*a*) is a top plan view and FIG. 1(*b*) is a cross-sectional view showing the shape of the sealing part of the plasma display panel of the first embodiment of the present invention.
Figure 1B:
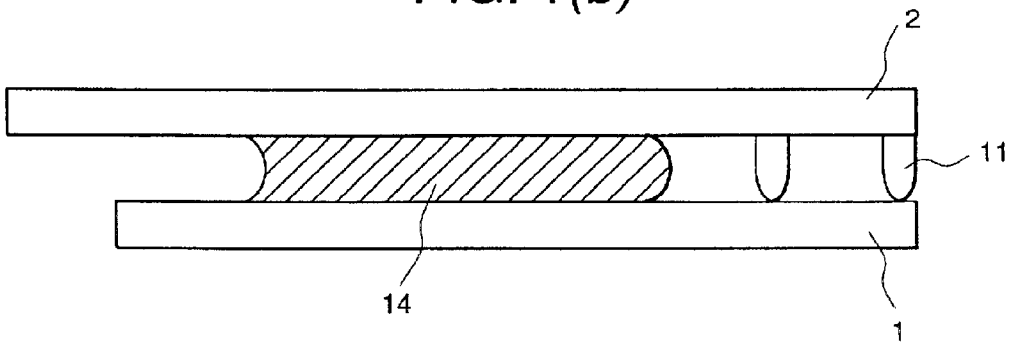

FIGS. 1(*a*) and 1(*b*) show the finished state of the sealing glass 14 between the substrates. FIG. 1(*a*) shows the sealing glass 14 as seen in the direction from the back of the display panel, in which its width extends approximately to 5 mm and protruding parts with a radius of curvature between 0.1 mm and 1 mm are observed over the entire perimeter of the discharge space. Though protruding parts of the sealing glass 14 having a larger volume, which are often observed when the sealing glass 14 beaks down due to the pressurizing clips, extend largely by break-down operations and thus those parts seem to be shaped in protruding parts, their radius of curvature is larger and their formation process and resultant shape is not different from the small-sized protruding parts in this embodiment. In addition, the small-sized protruding parts in this embodiment are not formed incidentally, but are formed in such a way that the sealing glass 14 is pulled toward the inside space when it gets soft, and this can be observed at the dispersed positions over the entire perimeter.

FIG. 1(*b*) shows the state of the sealing glass 14 as seen in a cross-section through the panel. The sealing glass 14 is broken down to the state in which its thickness becomes equal to the height of the separation wall 11, and the shape of its inside end part is convex with respect to the discharge space and the shape of its outside end part is concave. This can be interpreted in the following manner. In case the exhaust operations are applied during the sealing process or at a temperature exceeding the softening point after the sealing process, as the sealing glass gets soft, the sealing glass is pulled back inside the panel. However, for the viscosity at a temperature less than the working point, the sealing glass does not leak. Though the sealing glass near the substrate is not pulsed so much due to friction between the sealing glass and the substrate, the sealing glass near the center of the clearance gap between the substrates and located at a distance from the substrates tends to be pulled back inside the panel. Therefore, the shape of its inside end part is convex with respect to the discharge space and the shape of its outside end part is concave.

Figure 4A:
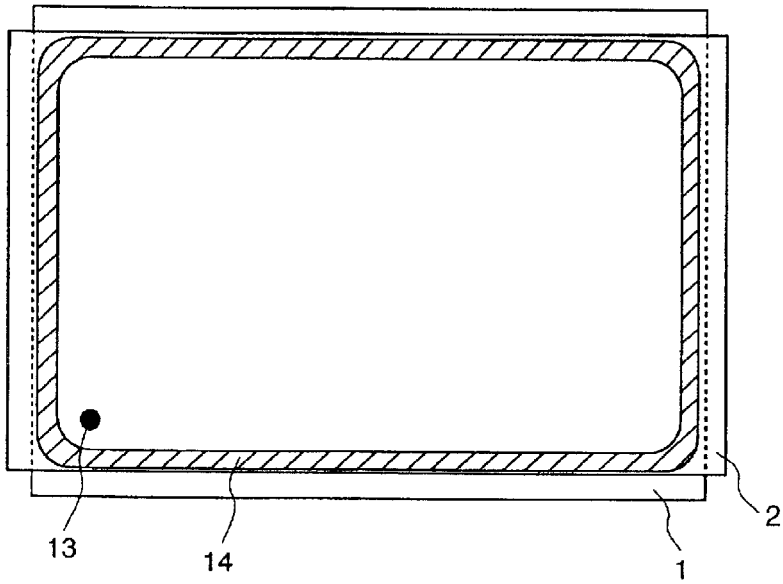
FIG. 4(*a*) is a top plan view and FIGS. 4(*b*) and 4(*c*) are side sectional views showing the shape of the sealing part of a conventional plasma display panel.
Figure 4B:
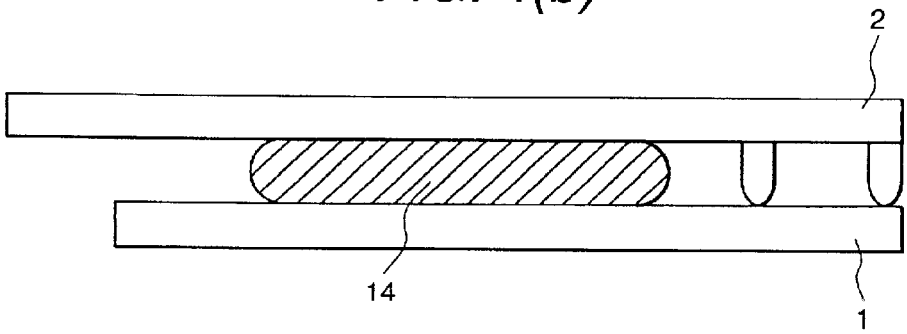
Figure 4C:
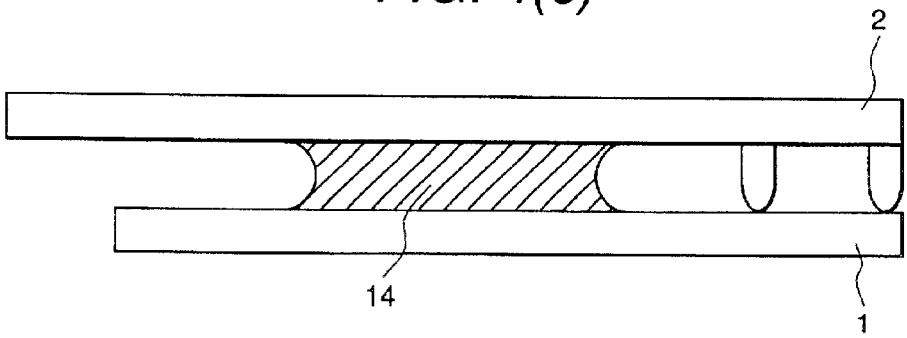

FIGS. 4(*a*) to 4(*c*) show the finished state of the sealing glass 14 between the substrates formed by the conventional sealing method using clip pressurization for comparison with this embodiment. FIG. 1(*a*) shows the sealing glass 14 as viewed in the direction from the back of the display panel, in which the shape of the sealing glass at the discharge space side and at the outside is defined by curves and smooth lines, respectively. As for the cross-sectional shape of the sealing glass 14 between the substrates, there are the case shown in FIG. 4(*b*), in which the sealing glass has a convex (humpbacked) surface at both the end facing the internal space and the end facing outside, and the case shown in FIG. 4(*c*), in which the sealing glass has a concave (double enveloping) surface at both ends. In general, the states of the sealing glass 14 as seen in cross-section through the panel formed by the sealing method using conventional clip pressurization can be categorized into either one of the status shown in FIGS. 4(*b*) and 4(*c*). As those states include a part having a small cross-sectional area parallel to the substrates, they tend to yield to the tensile load developed in the direction in which the substrates are to be removed. As for the state shown in FIG. 4(*b*), since all contact angles of the sealing glass 14 with respect to the substrate are 90 degrees or more, this state is very weak also with respect to sheering stress. In contrast, the state of the sealing glass 14, as seen in cross-section through the panel fabricated in association with this embodiment, has no dispersion in the cross-sectional area parallel to the substrate as shown in FIG. 4(*b*), which has a strong property against the tensile load developed in the direction in which the substrates are to be removed. As for the sheering stress, since this embodiment includes a portion in which the contact angle of the sealing glass 14 with respect to the substrate is 90 degrees or more, this embodiment is not superior to the structure shown in FIG. 4(*c*), but is stronger than the structure shown in FIG. 4 (b).

Thus, due to the fact that the internal end part is shaped so as to be convex with respect to the discharge space and the outer end part is shaped so as to be concave with respect to the discharge space, which is found in the panel fabricated in this embodiment, a gas discharge type display panel can be obtained which has sufficient strength with respect to the stress applied in various directions and provides a higher reliability in mechanical strength. By introducing the inert gas when sealing rather than employing an exhausting operation, the cross-section at both the internal space end part and the external end part of the sealing glass 14 can be formed to be convex with respect to the internal space.

Figure 5A:
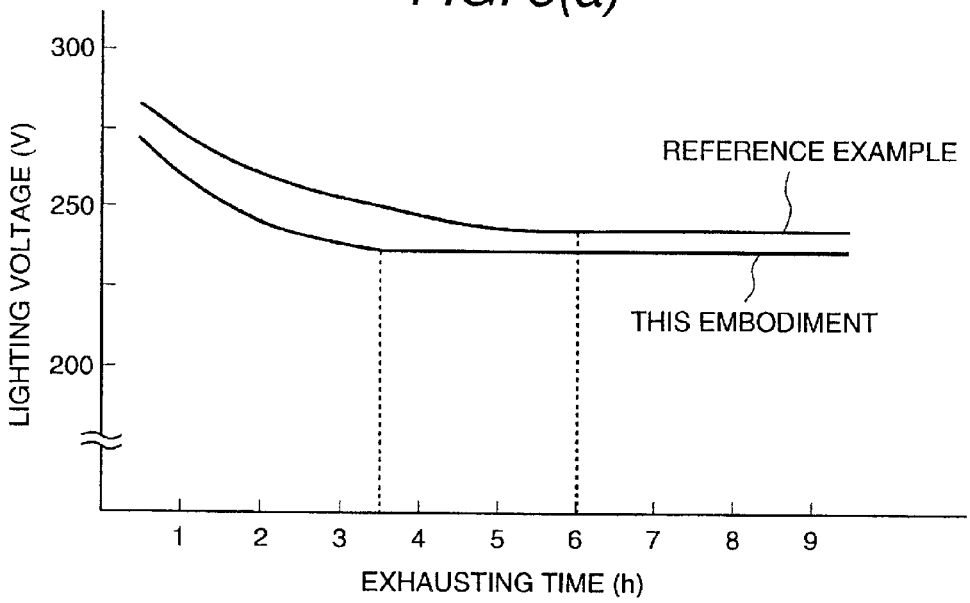
FIGS. 5(*a*) and 5(*b*) are graphs which show a relationship between the lighting voltage and the time for the exhausting and aging operations, respectively, in the first embodiment.
Figure 5B:
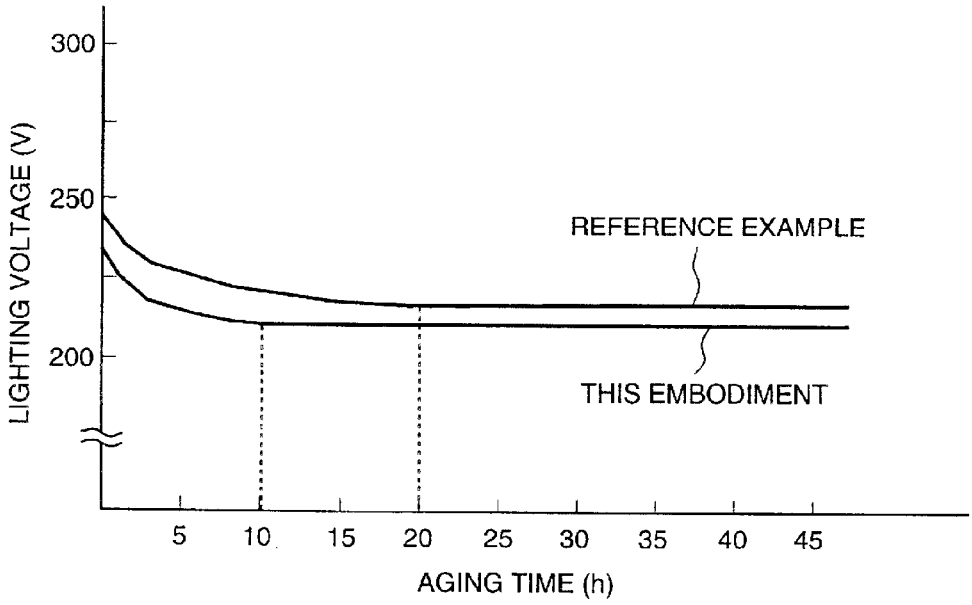

In order to study the effect of the exhausting operation initiated when sealing over the performance of the display panel, two types of panels were manufactured by varying the parameters Xh shown in FIG. 2 defined for the duration time for the exhausting operation, after which the lighting voltage was measured. Those panels included a panel according to this embodiment in which the exhausting operation was initiated when sealing, and a panel in the reference example in which the exhausting operation was initiated after the breaking down of the sealing glass 14. The measurement result is shown in FIG. 5(*a*). In the example of a plasma display panel, by applying the exhausting operation while maintaining a high temperature, the protection layer, the fluorescent material, the water absorbed in the separation walls and the gaseous impurities like carbon dioxide gas are removed, and thus, the discharge operation can be carried out at a lower voltage. However, when a designated time period passes, the gas absorbed in the protection layer and such is not released outside, or it may be absorbed again immediately after it is released. For example, in the case of the reference example shown in FIG. 5(*a*), even if the exhaust operation continues for 6 hours or longer, the lighting voltage does not change.

In order to establish a stable driving characteristic with a lower voltage for the gas discharge type display panel, such as a plasma display panel, it is the most preferable to maintain the exhausting operation for 6 hours even in this reference example. In this embodiment, the exhausting operation can be completed within 3.5 hours, and the light voltage can be reduced by 50V approximately. This is because a large amount of gaseous impurities are released in a shorter period of time owing to the exhaust operation initiated at a high temperature. This can be explained by referring to FIG. 6(*a*), which illustrates the exhaust gas flow routes in the panel. The exhaust gas flow routes are categorized into four groups including the gas flow route between the separation walls 11, the gas flow route around the separation walls 11, the exhaust hole itself and the exhaust pipe 13. In studying the former two categories in which the height of the gas flow route is at most between 100 mm and 200 mm, all the gas flow coming from the flow route between the separation walls 11 is converged into the flow route around the separation walls 11, and the exhaust conductance of the gas flow route around the separation walls 11 is the lowest in a panel in which the distance between the separation wall 11 and the sealing glass 14 is between 3 and 5 mm. Therefore, the exhaust operation with higher efficiency can be established by using the wider gas flow route around the separation wall 11.

Figure 6A:
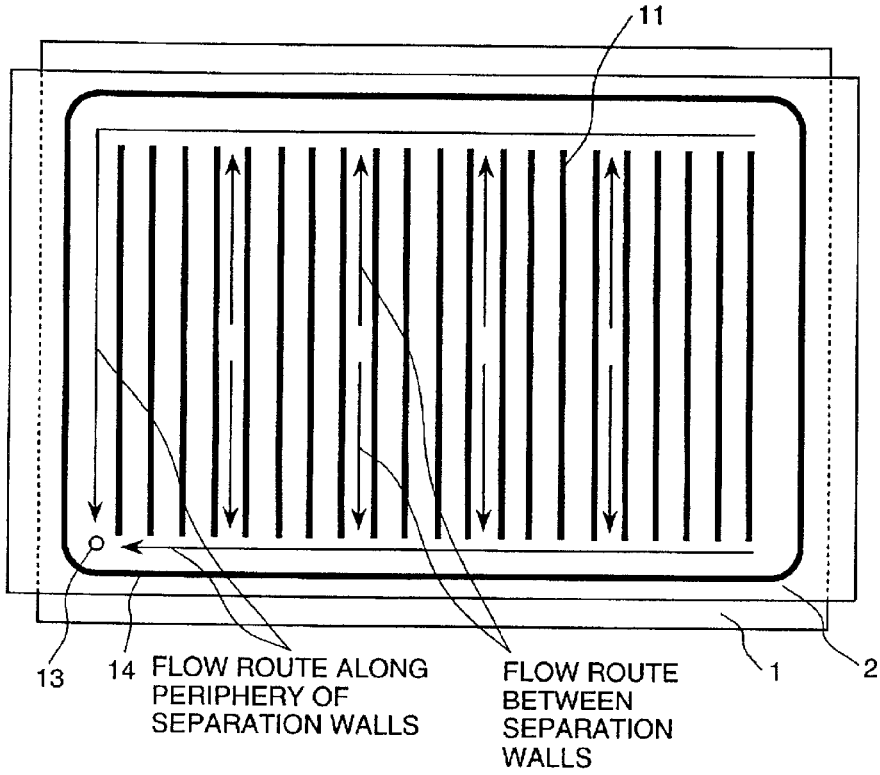
FIGS. 6(*a*) and 6(*b*) are diagrams which show an exhaust route of the plasma display panel.
Figure 6B:
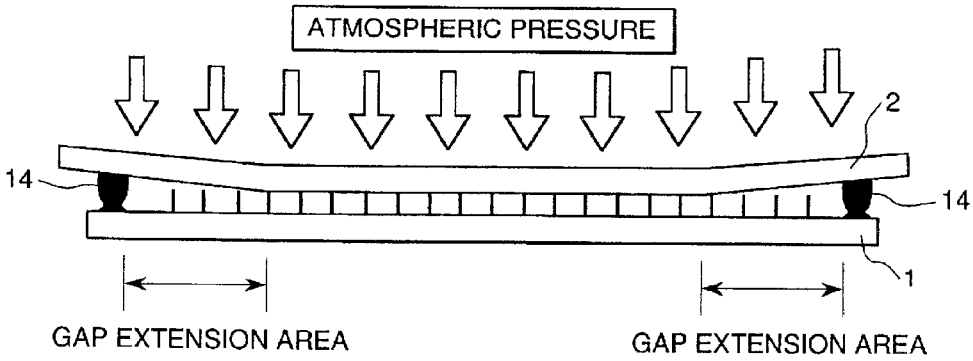

In this embodiment, the exhaust operation is performed in the states shown in FIG. 3(*b*), and the overall state of the panel during this operation is such that the substrate glass is deflected due to the atmospheric pressure, as shown in FIG. 6(*b*). The back substrate 2 and the separation wall 11 contact each other at the central part of the panel, and the clearance gap between them is formed by the sealing glass 14 working as a spacer disposed around the periphery. Since this gap defines a gas flow route around the separation wall 11 as an important structure determining the exhaust conductance level, the exhaust conductance can be increased by performing the exhaust operation before breaking down the sealing glass 14, as in this embodiment. Thus, the fact that the exhaust time is as short as 3.5 hours and the lighting voltage is low as shown in FIGS. 5(*a*) and 5(*b*) comes from a property that allows the gas to be easily exhausted.

In the plasma display panels, the gaseous impurities are spiked out from the structure components also by the plasma discharge which occurs during in the lighting in addition to the exhaust operation at high temperature. By making the best use of this property and continuing the lighting operation in a definite period of time before shipping the products, the gaseous impurities which were not released by the extraction operation at high temperature can be extracted from the structure component in order to light the panel stably with a low voltage, which is called aging and has come into wide use. FIG. 5(*b*) shows the relation between the aging time and the lighting voltage studied for the panel manufactured with the exhausting time required for the lighting voltage to converge to a steady value (6 hours for the reference example and 3.5 hours for this embodiment) as shown in FIG. 5(*a*). The aging time in the reference example is required to be as long as 20 hours, but the aging time in this example is only ten hours. This result reflects straightforwardly the difference in the concentration of the gaseous impurities before aging between those two cases.

As apparent from the foregoing description, the exhausting operation with higher efficiency can be performed without leakage at such a high temperature as not previously experienced, which makes it possible to reduce greatly the overall time for manufacturing the panel, including the aging process.

Figure 7:
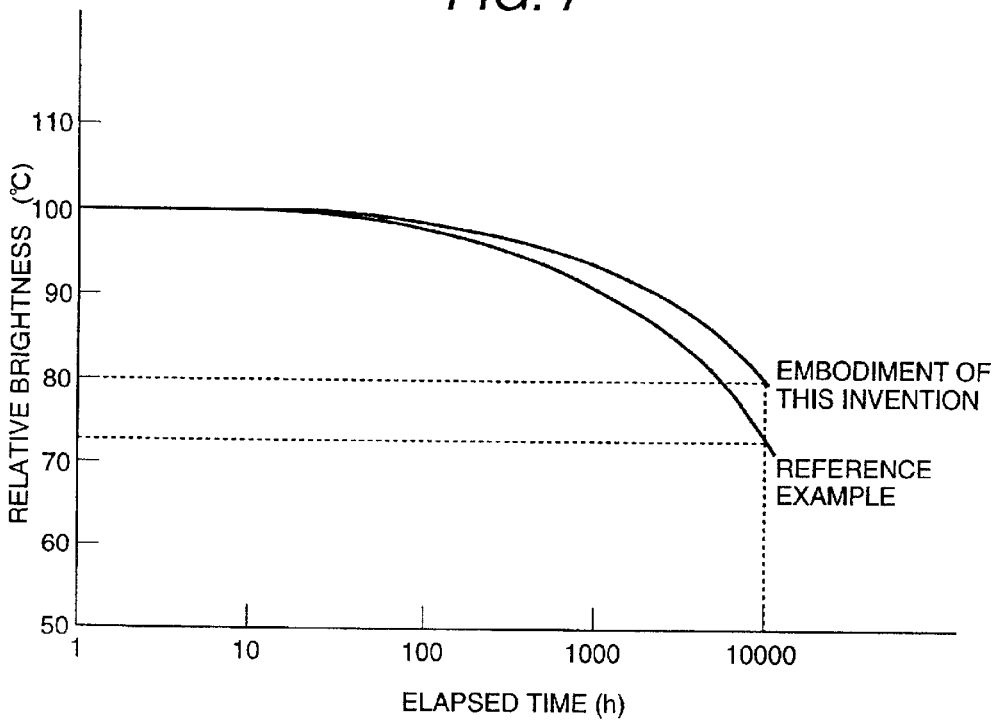
FIG. 7 is a graph which shows a variation per hour in the brightness in the prior art and in the first embodiment.

FIG. 7 shows the changes in the relative brightness during discharge operations measured for a panel formed by aging for 20 hours after applying the exhausting operation for 6 hours as a reference example, and the panel formed by aging for 10 hours after applying the exhausting operation according to this embodiment, assuming that the initial white brightness is normalized to 100%. The relative brightness in the reference example is reduced by 27% after continuing the discharge operation for 10,000 hours, and in contrast, the relative brightness in this embodiment is reduced by at most 20%. This result shows that, in the reference example, the inside of the panel is contaminated by gaseous impurities that are released from the sealing glass 14 over an extended time period even if the panel is finished by the aging process. In contrast, in this embodiment, since the sealing glass 14 has protruding portions having a radius of curvature between 0.1 mm and 1 mm and, hence, its surface area is larger, the gaseous component can be extracted efficiently from the sealing glass 14 in the exhausting operation, and, consequently, the amount of gas developed during the discharge operation can be reduced. Thus, if the sealing glass 14 is formed so as to have protruding portions having a curvature radius between 0.1 mm and 1 mm as viewed in the direction from the display panel along the overall periphery in the internal space of the sealing glass 14, it can be concluded that a decrease in the brightness while lighting the panel for an extended time period can be avoided. Since the surface area at the protruding portions having a radius of curvature less than 0.1 mm or exceeding 1 mm does not change too much, its brightness may undesirably decrease as much as the brightness for the reference example does. In addition, as apparent from the description of the manufacturing method for the panels, it is possible to manufacture the gas discharge type display panel without using pressurizing clips. In a method in which only four clips for positioning as shown in FIG. 3 are used for temporarily fixing the panel, a couple of 42-inch AC-type plasma display panels formed together so as to be adjacent to each other on a common large-sized substrate are successfully sealed. Since the boundary portion between two panels can not be fully pressurized only by the use of conventional clips 16 for pressurizing the frit, and, hence, the resultant display panel is easily broken due to camber or distortion, the yield rate for sealing is as low as 10% or less, and color mixture is found in the portions to which the pressurization was not fully applied. Thus, we could not obtain 42-inch sized panels satisfying practical performance requirements. In contrast, by using the sealing method of this embodiment, we could obtain panels with a yield rate of more than 90% providing the same satisfactory performance level as the panels formed by sealing individual panels separately. In case of applying the sealing method of this embodiment, plural large-sized panels can be sealed all at once with higher yield rate, which is valid for achieving a higher productivity and reduction of the manufacturing cost. As for the bonding method for the exhaust pipe 13, there is a method in which the upper face of the flared part of the exhaust pipe 13 and the back glass substrate are bonded by the sealing glass 14 (paste or preform), which is used for mass-production and has become popular. It may be possible to apply this method to this case if some problems on leakage occur, while a reduction of the pressure in the sealing operation could be solved by using an exhaust pipe 13 that is shaped so as to enable a firm contact between the exhaust pipe 13 and the back face substrate 2 and such.

(Embodiment 2)

In the second embodiment of the present invention, a plasma display panel is formed by using the different exhaust gas temperature from the first embodiment. FIGS. 8(*a*) to 8(*d*) shows the temperature profile for the sealing and exhausting processes.

Figure 9:
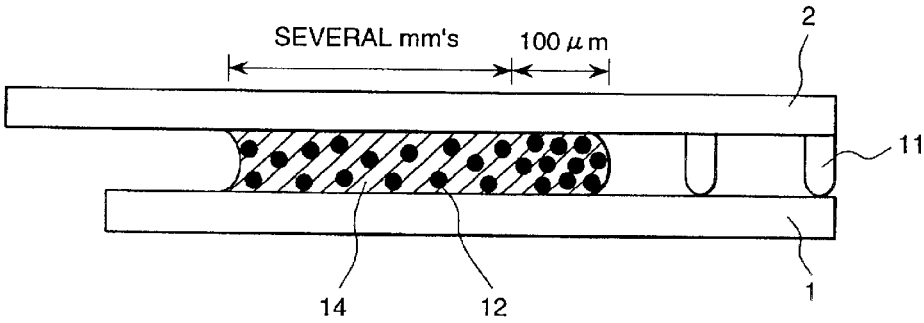
FIG. 9 is a side sectional view which shows a shape and a state of the sealing part of the plasma display panel.
Figure 8A:
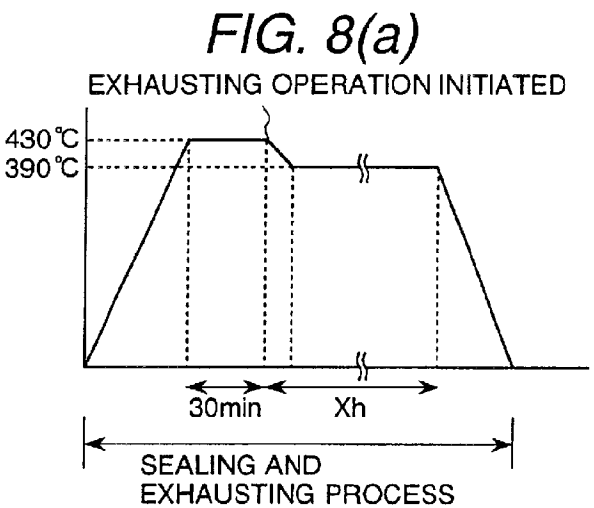
FIGS. 8(*a*) to 8(*d*) are diagrams which show temperature profiles at the sealing and exhausting operations in the second embodiment.
Figure 8B:
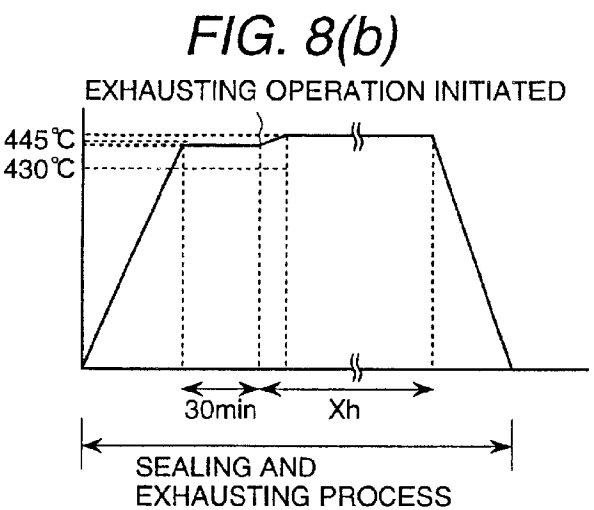
Figure 8C:
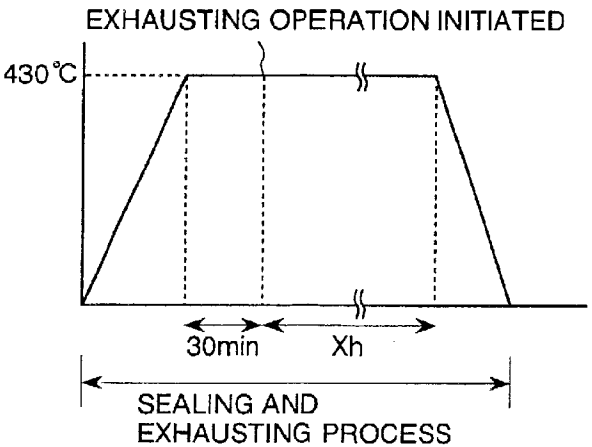
Figure 8D:
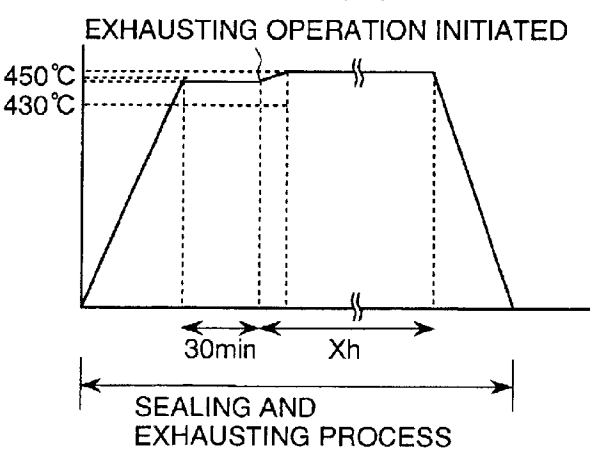

Another plasma display panel is formed by a procedure which includes initiating the exhausting operation after holding the temperature at 430° C. for 30 minutes and then cooling the panel down to room temperature without maintaining the temperature constant while reducing the temperature. The cross section of the resultant plasma display panel as seen in the direction perpendicular to the back side substrate 2 is then observed. FIG. 9 illustrates diagrammatically the state of the sealing glass 14.

For the panel formed at 450° C. among the panels formed by varying the exhaust gas temperature, the viscosity of the sealing glass 14 is reduced too much and a leakage is formed in the glass for sealing the substrate. In case of sealing the substrate with amorphous glass, this is not preferable because the leakage may occur when exhausting the gas at a temperature higher than the working point. There is no leakage for a panel formed with a temperature of 455° C. at the same temperature level as above. This can be interpreted by considering the special distribution of the filler 12. The filler is distributed uniformly in cross section as shown in FIG. 4(*b*) to which the conventional sealing method is applied. However, in the case of this embodiment in which the exhaust operation is applied to the sealing glass 14 having a lower viscosity, that is, at the sealing temperature, the filler 12 is pulled toward the discharge space, as shown in FIG. 9, and then the filler concentration at the discharge space becomes higher. The liquidity at the discharge space herewith decreases, and then the leakage is blocked. Consequently, the exhaust operation can be performed even at the relatively higher temperature of 445° C., near the working point. The filler distribution state is quantitatively shown in FIG. 9, in which the average filler concentration at the portion extending in by 100 $\mu$m from the end part facing the discharge space is 10% or more higher than the other portions. Though the extreme concentration of the filler at any part makes its thermal expansion smaller and may unfavorably cause cracks and/or distortion due to the difference in the thermal expansion between this part and the substrate, there is no problem in fact because the distortion can be released by the protruding portions formed as shown in FIG. 1.

Exceptionally, if the extreme concentration of the filler occurs over the portions extending in by more than 100 m, this is unfavorable because cracks and/or distortion may occur due to the difference in the thermal expansion between those portions and the substrate.

If the increase in the average concentration of the filler at the portion extending in by 100 m from the end part facing the discharge space is 10% or less, the effect given to the liquidity of the sealing glass 14 is small, and the sealing glass 14 moves toward the inside space at the relatively higher temperature near the working point. Thus, as this makes the exhaust route narrower, it is preferable to control the increase in the average concentration of the filler within 10%.

Figure 10A:
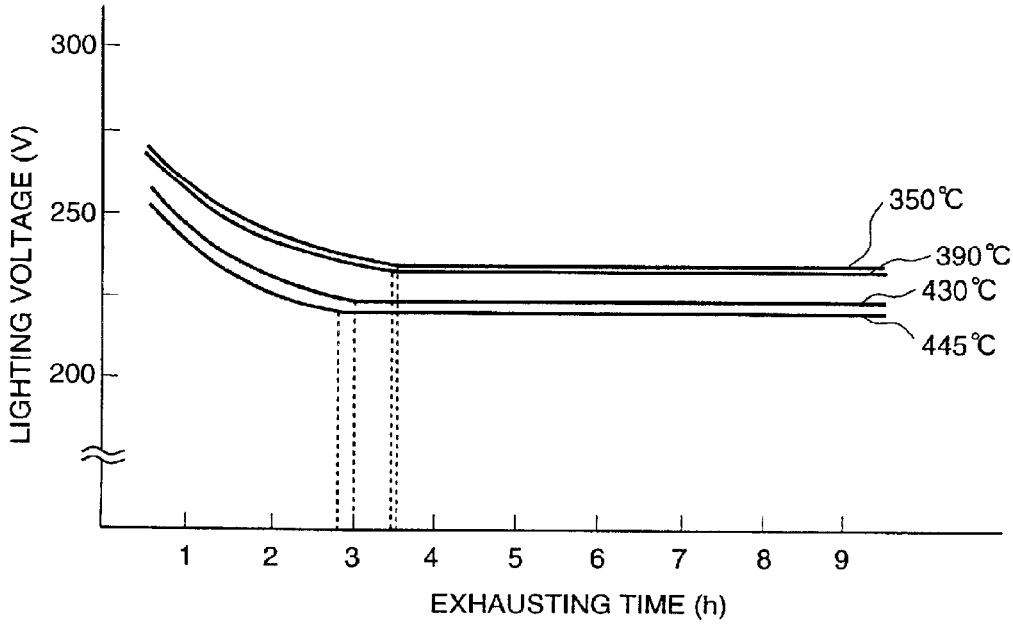
FIGS. 10(*a*) and 10(*b*) are graphs which show a relationship between the lighting voltage and the time for the exhausting and aging operations, respectively, in the first embodiment.
Figure 10B:
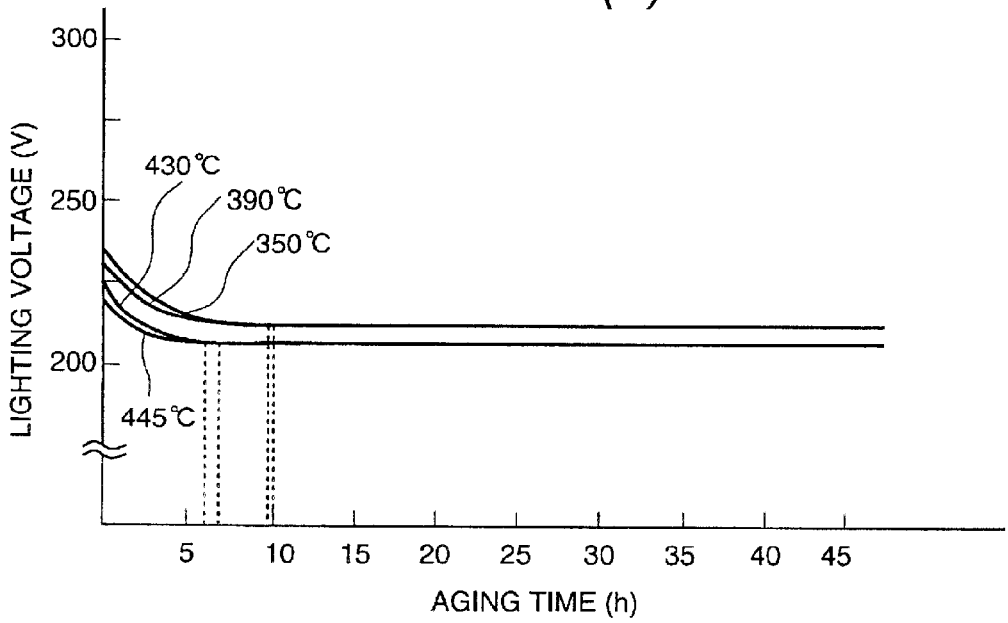

FIG. 10(*a*) shows the result of studying the lighting voltage by changing the exhaust time denoted by Xh, as shown in FIG. 2. FIG. 10(*b*) shows the relation between the aging time and the lighting voltage. FIG. 10 also includes the result for the case of an exhausting operation at 350° C., which was described with reference to the first embodiment. As shown in FIG. 10(*a*), the longer the exhausting operation continues at a higher temperature, the more the concentration of the remaining gaseous impurities is reduced and the lower the lighting voltage can be maintained. As for the exhausting time, though the exhausting conductance of the panel is not high when the temperature is kept constant after breaking down of the sealing glass 14, the required exhausting time can be made shorter at the higher temperature because the gaseous impurities are removed more quickly at the higher temperature. It is believed to be apparent that no leakage occurs by adjusting the exhausting time, even if a temperature higher than the softening point is maintained for 9 hours.

FIG. 10(*b*) shows that the aging operation can be performed in a shorter period of time if the exhausting operation is applied at a higher temperature, and that the lighting voltage can be made lower. This reflects the fact that the concentration of the remaining gaseous impurities for the panel, in which the exhausting operation is applied at a higher temperature, reaches a lower level before the aging operation begins, and that the amount of the gaseous impurities to be removed during the aging operation can be reduced. As described above, what we can obtain is a gas discharge type display panel in which the exhausting operation can be applied in a highly efficient way by exhausting the panel at a higher temperature and in which the concentration of the remaining gaseous impurities can be made lower.

(Embodiment 3)

Figure 11A:
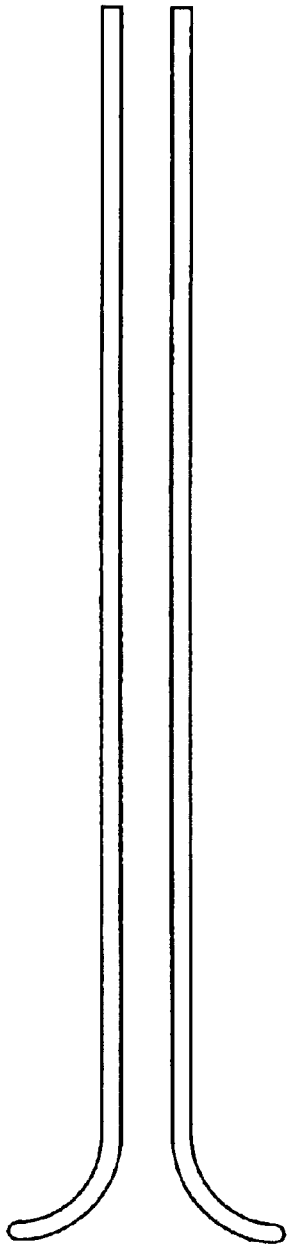
FIGS. 11(*a*) and 11(*b*) are cross-sectional views showing the shape of an exhaust pipe 13.
Figure 11B:
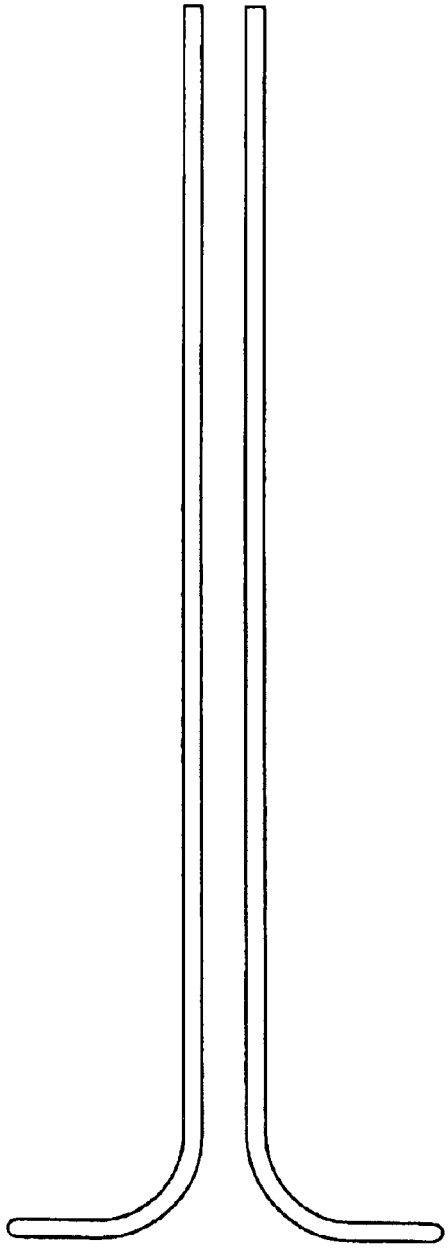

In the third embodiment of the present invention, a plasma display panel is manufactured by using a crystalline glass frit (with the softening point at 390° C., the crystallization peak temperature at 430° C. and a filler included) for the sealing glass 14 and an amorphous glass frit (with the softening point at 390° C., the working point at 430° C. and a filler included) for the seal frit bonding between the exhaust pipe 13 and the back substrate 2, and by using an exhaust pipe 13 having a sectional form as shown in FIG. 11(*a*) or FIG. 11(*b*). This manufacturing method is the same as that of embodiment 1, and it uses two temperature profiles of the type shown in FIG. 2, including the case (a) in which the first heat reserving process continues for 5 minutes and the second heat reserving process continues for 3.5 hours, and the case (b) in which the first heat reserving process continues for 10 minutes and the second heat reserving process continues for 3.5 hours.

The exhausting process can be applied with no problem by using an exhaust pipe having a larger connecting area as shown in FIG. 11(*b*). Even with the exhaust pipe having a smaller connecting area as shown in FIG. 11(*a*), the exhausting process can be applied properly by using crystalline glass for sealing the exhaust pipe 13, as in the embodiments 1 and 2, and using amorphous glass for sealing the substrates. This means that if the glass material used for sealing the exhaust pipe 13 has a heat resistance higher than the sealing glass 14 for the substrates, the viscosity of the glass material for sealing the exhaust pipe 13 is maintained to be a certain level, and no leakage occurs even if the viscosity of the sealing glass 14 for the substrates might decrease at the sealing temperature. In case both of those glass materials have an identical viscosity, leakage may occur if the bonding area between the exhaust pipe 13 and the substrates is not large enough. No matter what shape is used for the exhaust pipe 13, materials with higher heat resistance are preferably used for the glass for sealing the exhaust pipe 13, rather than for the sealing glass 14 for the substrates. Though it is possible to use amorphous glass materials for both in order to define a difference in their characteristic temperature, too large a difference in their characteristic temperature can not be defined, because those sealing glasses are required ultimately to be sealed, which leads to a difficulty in selecting the glass material. By using a crystalline glass for sealing the exhaust pipe 13 and using an amorphous glass for sealing the substrates, it will be appreciated that their characteristic temperature could not be limited to each other, and that they can be heated up to a temperature higher than the sealing temperature after sealing, which concludes the fact that this combination of glass materials is most preferable.

A plasma display panel was formed at the above-mentioned two temperature profiles, and, by using the exhaust pipe 13 as shown in FIG. 11(*b*), and the thickness of the sealing glass 14 after the sealing operation was measured and evaluated. It was found that the panel (a) broke down to the height approximately equivalent to the height of the separation wall 11, and that the panel (b) did not fully break down. This shows that the sealing glass 14 gets hard as crystallization proceeds to a certain degree and that it can not be fully broken down to a desired height. As in this embodiment, by using amorphous glass material for the sealing glass 14, the freedom in the temperature profiles can be advantageously enhanced.

(Embodiment 4)

Figure 12:
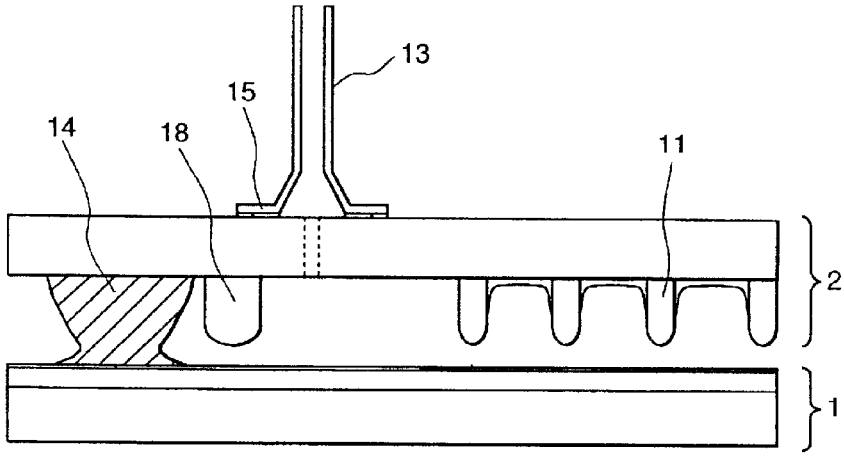
FIG. 12 is a cross-sectional view of the plasma display panels of the fourth embodiment and the prior art.
Figure 13:
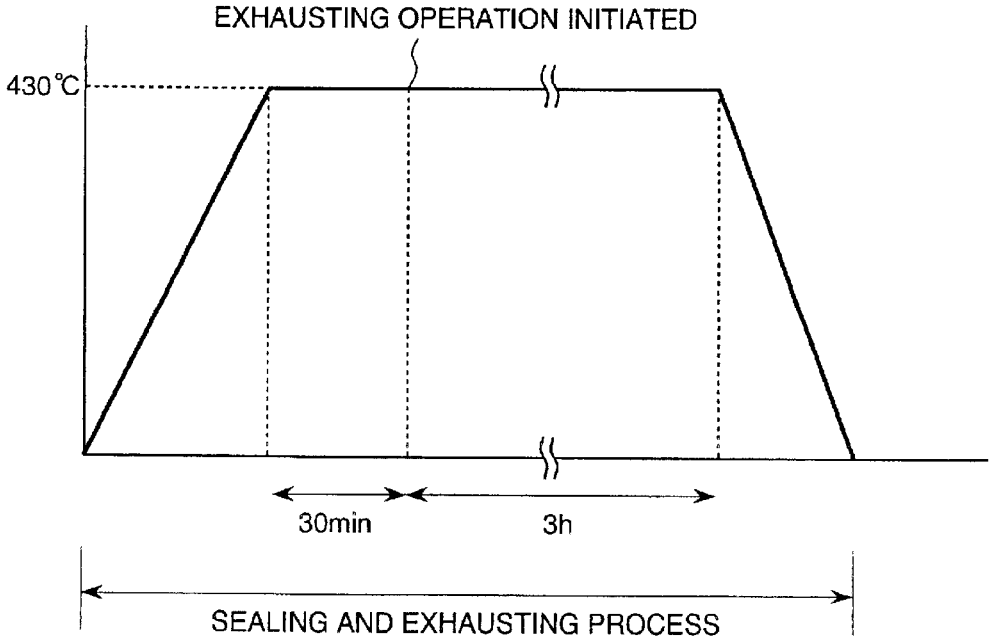
FIG. 13 is a graph which shows temperature profiles at the sealing and exhausting operations in the fourth embodiment.

In the fourth embodiment of the present invention, a plasma display panel is manufactured by using a crystalline glass frit (made with $V_2O_5$—$P_2O_5$ system, and having a softening point at 390° C., a crystallization peak temperature at 430° C. and a filler included) for the sealing glass 14 and an amorphous glass frit (made with PbO—$B_2O_3$ system and having a softening point at 390° C., a crystallization peak temperature at 430° C. and a filler included) for the seal frit bonding between the exhaust pipe 13 and the back substrate 2. As shown in FIG. 12, this panel has an additional separation wall 18 with 1 mm width along the overall periphery inside (within 2 mm) of the sealing glass 14. The fabrication method for this panel is almost the same as the panel in the first embodiment except for the addition of the separation wall 18, and the temperature profile used for the sealing and exhausting processes is shown in FIG. 13.

As a result, the gas inside the panel having the structure shown in FIG. 12 can be fully exhausted. This is because the sealing glass can be blocked by the separation wall 18 when the sealing glass is pulled inside the discharge space by the exhausting operation, and thus, the width of the sealing glass can be made uniform and the occurrence of the leakage path can be prevented. This separation wall 18 gives such an effect that, even if the protruding portion formed at the discharge space by the exhausting operation is removed by the exhausting operation further continued, this protruding portion will not extend into the inside of the discharge space and block the exhausting route, and will not remain between the separation wall 18 and the front substrate 1. Although the separation wall 18 is formed inside the sealing glass 14 in this embodiment, the same effect can be obtained by forming a sealing glass having a higher softening point as a "levee" inside the sealing glass 14.

(Embodiment 5)

Figure 14:
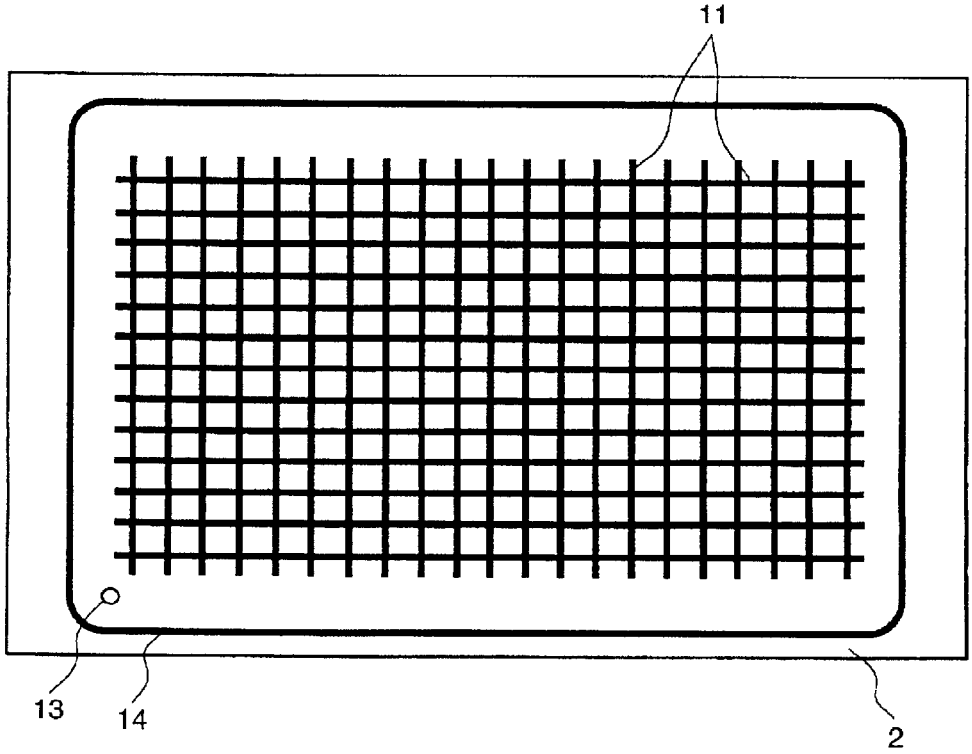
FIG. 14 is a top plan view of the back substrate 2 of the fifth embodiment.
Figure 15:
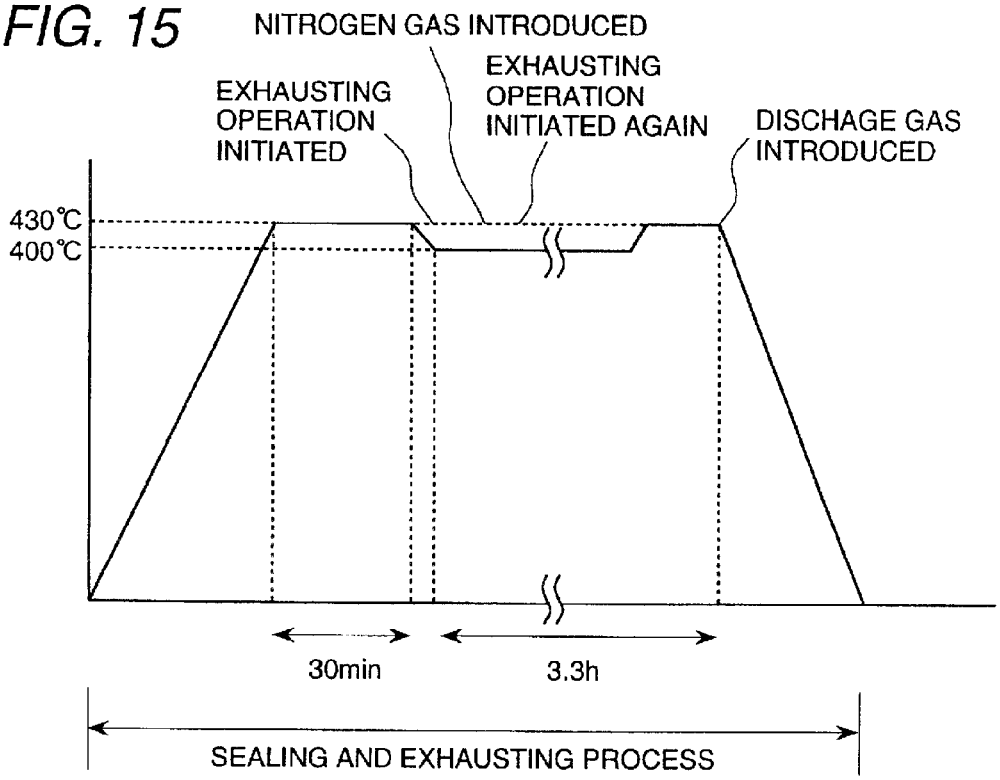
FIG. 15 is a graph which shows temperature profiles at the sealing and exhausting operations in the fifth embodiment.

In the fifth embodiment of the present invention, a plasma display panel is manufactured by forming separation walls 11 extending in the vertical and horizontal directions, as shown in FIG. 14, having the same material structure as the first embodiment. The manufacturing method for the front substrate 1 and the back substrate 2 and the number of pixels of the panel are the same as those in the first embodiment. Only the sealing and exhausting processes for this embodiment will be described below. The temperature profile used for the sealing and exhausting processes is shown in FIG. 15.

(1) At first, the substrates are aligned and fixed temporarily and the exhaust tube 13 is fixed in the same manner as the first embodiment. Therefor, the composite substrates are installed in the furnace and the exhaust head is connected to the exhaust pipe 13. The temperature is increased up to the sealing temperature of 430° C. in this configuration. Though the sealing glass 14 gets soft and contacts the front substrate 1 and the periphery of the substrate is sealed hermetically, the clearance gap between the substrates does not reach the height of the separation wall 11 because pressurization clips are not used. On the other hand, the seal frit 15 used for bonding the exhaust tube 13 and crystallization in the back glass substrate is not fully developed at this step, and its viscosity remains low.

(2) After the sealing temperature reaches 430° C., this temperature is maintained for 30 minutes. During this period, the seal frit 15 establishes its crystallization and the exhaust pipe 13 is bonded firmly to the back substrate 2. The temperature is then reduced to 400° C. in this state.

(3) After the temperature reaches 400° C., the exhausting operation is initiated. The sealing glass 14 stays in such a state that it has a higher viscosity and is less apt to be broken down than at the temperature of 430° C. Thus, the exhausting operation is applied in a state in which the clearance gap between the front substrate 1 and the back substrate 2 is large. As the exhausting operation for the center part of the panel can not be performed efficiently due to the deflection of the substrate glass, as shown in FIG. 6(*b*), the exhausting operation is applied again after introducing nitrogen gas in the process, fixing the deflection and thus facilitating the removal of the gaseous impurities.

The temperature is raised to 430° C. while continuing the exhausting operation after 3 hours has passed since the beginning of the exhausting operation.

(4) Along with the increase in the temperature, the sealing glass 14 gets soft and is broken down due to the pressure difference between the inside and outside of the panel. After completing the breaking-down of the panel, Ne gas including Xe gas by 3% volume at room temperature is introduced into the discharge space through the exhaust pipe 13 at 700 Torr so that its pressure may reach 300 Torr, and the temperature is reduced down to the room temperature. After cooling down, the exhaust pipe 13 is burned off by local heating, and finally, production of a gas discharge type display device is completed.

Since the exhausting operation is applied after breaking down the sealing glass in the conventional panel manufacturing method, a gas discharge type display panel in which the discharge space is separated into isolated cells by the separation walls 11, as shown in FIG. 14, can not be exhausted completely. In this embodiment, since the exhausting operation can be applied in a state in which the clearance gap between the front substrate 1 and the back substrate 2 is kept large enough, and the removal of gaseous impurities remaining in the internal space can be facilitated by introducing inert gas such as nitrogen gas, the exhausting operation and the removal of the gaseous impurities can be performed with high efficiency.

The cell structure shown in FIG. 14 contributes to an increase in the effective area for applying fluorescent materials, and thus, a brightness of 500 cd/m2 can be attained in comparison with a brightness 350 cd/m2 in the cell structure shown in FIG. 6(*a*).

(Embodiment 6)

In the sixth embodiment of the present invention, in a manner similar to that of the fifth embodiment, a plasma display panel is manufactured by forming separation walls 11 extending in a vertical and horizontal directions, as shown in FIG. 14, and sealing the substrates doubly with two kinds of sealing glass having an individual softening point that are different from each other. As for the sealing glass outside, what is uses is a low softening-point amorphous seal frit 20, which has a softening point at 350° C. and the working point 410° C. As for the sealing glass inside, what is used is a high softening-point amorphous seal frit 19, which has the softening point at 390° C. and the working point 450° C. A crystalline glass frit 15 has a softening point at 350° C. and a crystallization peak temperature at 400° C. for bonding between the exhaust pipe and the substrate. Those seal frits include filler materials.

Figure 16:
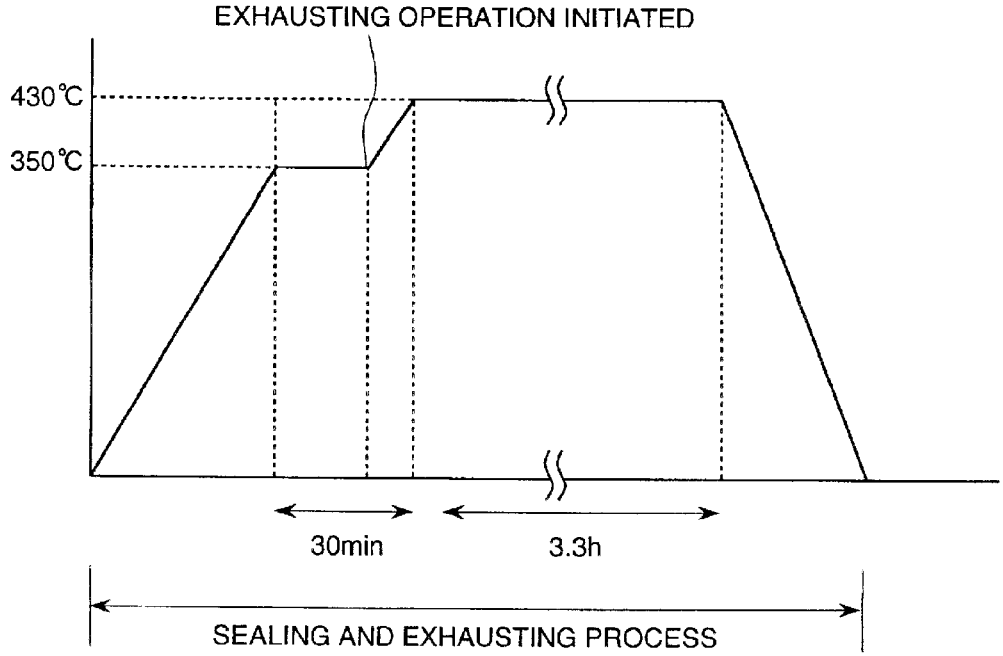
FIG. 16 is a graph which shows temperature profiles at the sealing and exhausting operations in the sixth embodiment.
Figure 17A:
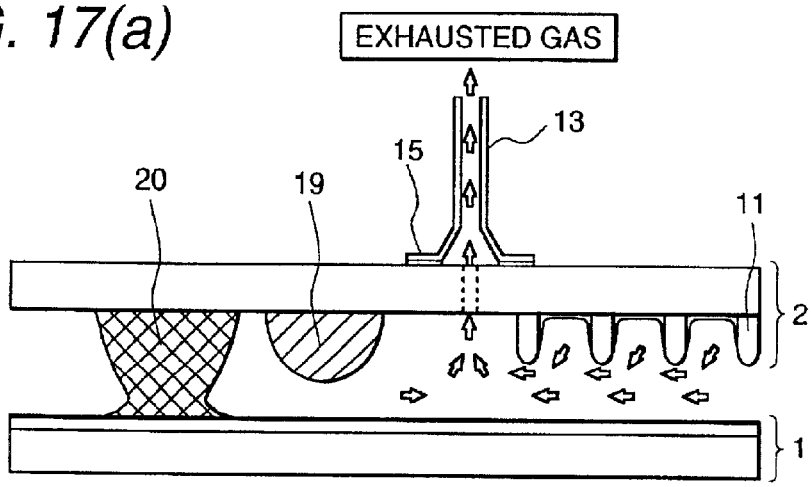
FIGS. 17(*a*) to 17(*c*) are side sectional views which illustrate stepwise changes in the panel formation after the sealing process in the sixth embodiment of the present invention.
Figure 17B:
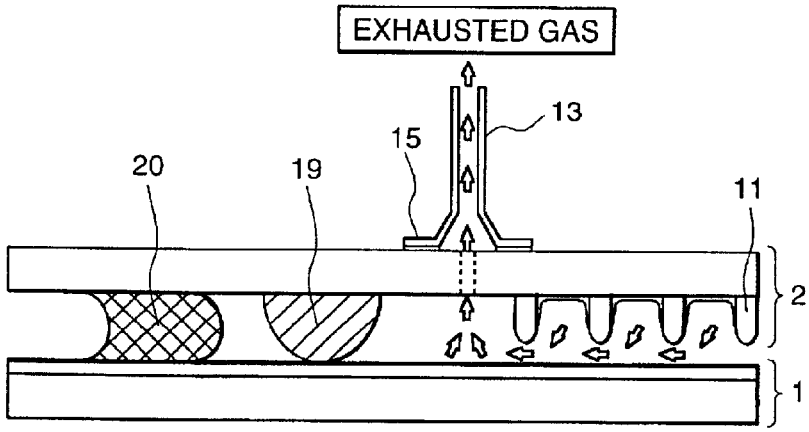
Figure 17C:
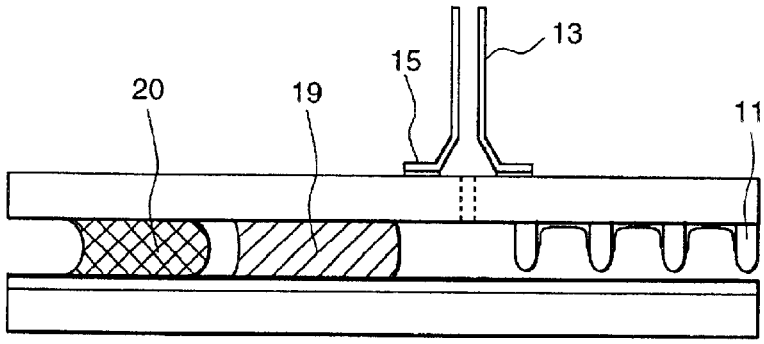

The method of manufacture of the front substrate 1 and the back substrate 2 and the number of pixels are the same as those in the first embodiment, except that the seal frits are formed doubly. The sealing and exhausting operations will be described below. The temperature profile used in the sealing and exhausting operations is shown in FIG. 16. FIGS. 17(*a*) to 17(*c*) show the stepwise change in the state of the panel that is sealed in two steps.

(1) At first, the substrates are aligned and fixed temporarily and the exhaust tube 13 is fixed in the same manner as the first embodiment. Then, the composite substrates are installed in a furnace and the exhaust head is connected to the exhaust pipe 13. The temperature is increased up to the sealing temperature of 350° C. in this configuration. The crystalline glass frit used for bonding the exhaust pipe 13 and the back glass substrate stays in a state in which its viscosity is low.

(2) After the sealing temperature reaches 350° C., this temperature is maintained for 30 minutes. The state at this step is shown in FIG. 17(*a*). The low softening-point seal frit 20 gets soft and contacts the front substrate 1. Although the periphery of the substrate is sealed tightly, the clearance gap between the substrates does not reach the height of the separation wall 11 because no pressurization clip is used. While keeping the temperature constant for 30 minutes, the crystalline glass 15 experiences a reduction of the grain size of the glass, a fixation with the substrate glass and a slight crystallization, and so the exhaust pipe 13 is fixed firmly to the back glass substrate. The exhausting operation (exhausting roughly) is initiated at this step.

(3) In the process of increasing the temperature up to 430° C., although the low softening-point seal frit 20 is broken down, the high softening-point seal frit 19 does not get very soft and prevents the substrates from contacting firmly to each other by acting as a spacer, as shown in FIG. 17(*b*). On the other hand, the crystalline glass used for bonding the exhaust pipe 13 gradually develops its crystallization, and thus, the bonding between the exhaust pipe 13 and the back glass is firmly established.

(4) As the temperature reaches 430° C., the high softening-point seal frit 19 begins to get soft and contacts the front substrate 1, and the sealing of the panel can be established by the high softening-point seal frit 19 itself. The exhausting operation is further continued up to a higher vacuum at this step.

(5) In the process of maintaining the temperature constantly at 430° C., both the high softening-point seal frit 19 and the low softening-point seal frit 20 are broken down by the pressure difference between the inside and outside of the panel. The state at this step is shown in FIG. 17(*c*). After cooling down to the room temperature, a discharge gas is introduced into the discharge space through the exhaust pipe 13 so that its pressure may reach 300 Torr, and the exhaust pipe 13 is burned off by local heating, whereby production of a gas discharge type display device is completed.

Although there may occur a leakage from the seal frit 15 used for bonding the exhaust pipe 13 with the exhausting operation at 350° C., the exhausting operation can be applied successfully by keeping its internal pressure at a low degree of vacuum. In case a single kind of seal frit is used as in the first embodiment, it is difficult to determine the exhausting temperature properly and have a higher flexibility in selecting the temperature, because it is desirable to apply the exhausting operation without making the seal frit get soft at a higher temperature. In this embodiment, depending on the combination of characteristic temperatures for two or more kinds of seal frits, various temperature profiles can be developed. In this embodiment, since the exhausting operation can be initiated even during the process of increasing the temperature, and the exhausting operation can continue at the sealing temperature for the high softening-point seal frit, the exhausting operation can be applied with extremely high efficiency.

As shown in FIG. 10(*b*), though the aging operation is required approximately for 6 hours even by applying the exhausting operation at 430° C. for the single-layered sealing configuration, no difference is formed in the lighting voltage after applying the aging operation in this embodiment, which reflects the fact that the concentration of the gaseous impurities in the panel is low. In the sealing and exhausting method using two kinds of seal frits, as in this embodiment, either of the high softening-point glass and the low softening-point glass may be positioned inside, and the multiple sealing 1 configuration may contribute to no further extension of its essential effect.

It is possible in the shortest time and with higher operability to manufacture a plasma display panel having a high mechanical strength and a high reliability, and which is able to be driven with a lower voltage, providing a higher brightness and which has a large dimension.

What is claimed is:

1. A manufacturing method for a gas discharge type display panel in which a couple of substrates are arranged to be facing to each other, a surrounding area of said couple of substrates is sealed by a sealing glass, and an inside space is used as a discharge space by sealing a discharge gas in an internal space, wherein by exhausting said inside space when sealing, said sealing glass is made broken down and a clearance gap between said substrates is controlled to be as desired.

2. A manufacturing method for a gas discharge type display panel in claim 1, wherein an amorphous glass or an amorphous glass including a filler are used for sealing a substrate.

3. A manufacturing method for a gas discharge type display panel in claim 1, wherein a supply and exhaust pipe is formed on an outside surface of said substrate by using a glass material having a heat resistance higher than said substrate sealing glass.

4. A manufacturing method for a gas discharge type display panel in which a couple of substrates are arranged to be facing to each other, a surrounding area of said couple of substrates is sealed by an amorphous sealing glass, and an inside space is used as a discharge space by sealing a discharge gas in an internal space, wherein a gas unnecessary for a discharge operation is exhausted from said inside space under a condition that said amorphous sealing glass is located in a temperature range exceeding its softening point and no more than its working point.

5. A manufacturing method for a gas discharge type display panel in which a couple of substrates are arranged to be facing to each other, a surrounding area of said couple of substrates is sealed by a sealing glasses, and an inside space is used as a discharge space by sealing a discharge gas in an internal space, wherein said surrounding area of said couple of substrates is sealed at least doubly by said sealing glasses each having an individual softening point different from each other, one of said sealing glasses having one individual softening point sealing said surrounding area, and another of said sealing glasses having another individual softening point and disposed adjacent to and substantially parallel with said one of said sealing glasses so as to individually effect sealing of at least the same said surrounding area.

6. A manufacturing method for a gas discharge type display panel in which a couple of substrates are arranged to be facing to each other, a surrounding area of said couple of substrates is sealed by a sealing glass, and an inside space is used as a discharge space by sealing a discharge gas in an internal space, wherein a protruding portion having a curvature radius between 0.1 mm and 1 mm is formed on an overall periphery of said sealing glass at its inside space.

7. A manufacturing method for a gas discharge type display panel in which a couple of substrates are arranged to be facing to each other, a surrounding area of said couple of substrates is sealed by a sealing glass, and an inside space is used as a discharge space by sealing a discharge gas in an internal space, wherein at least at one portion of said surrounding area of said couple of substrates, a cross-section of said sealing glass viewed vertically to a substrate of said couple of substrates is shaped so as to be convex with respect to said inside space at both its inside space end part and its outside end part.

8. A manufacturing method according to claim 7, wherein a gas unnecessary for a discharge operation is exhausted from said inside space if a state of said sealing glass is located in a temperature range exceeding its softening point and no more than its working point.

9. A manufacturing method according to claim 7, wherein at least at one portion of a surrounding area of said substrate, a concentration filler at an inside space end part of said sealing glass is larger than that in other portions.

10. A manufacturing method according to claim 7, wherein a glass layer having a heat resistance higher than said sealing glass is formed so as to be adjacent to an inside space and part of said sealing glass or within 2 mm from an end part.

11. A manufacturing method according to claim 7, wherein another sealing glass is provided so that said couple of substrates are sealed at least doubly by said sealing glass and another sealing glass, each having an individual softening point different from each other.

12. A manufacturing method according to claim 7, wherein by exhausting said inside space when sealing, said sealing glass is made broken down and a clearance gap between said substrates is controlled to be as desired.

13. A manufacturing method for a gas discharge type display panel in which a couple of substrates are arranged to be facing to each other, a surrounding area of said couple of substrates is sealed by a sealing glass, and an inside space is used as a discharge space by sealing a discharge gas in an internal space, wherein at least at one portion of said surrounding area of said couple of substrates, a concentration of filler at an inside space end part of said sealing glass is larger than that in other portions.

14. A manufacturing method for a gas discharge type display panel in which a couple of substrates are arranged to be facing to each other, a surrounding area of said couple of substrates is sealed by a sealing glass, and an inside space is used as a discharge space by sealing a discharge gas in an internal space, wherein a glass layer having a heat resistance higher than said sealing glass is formed over an entire periphery of said inside space so as to be adjacent to an inside space end part of said sealing glass or within 2 mm from the inside space end part.

* * * * *